US008393822B2

(12) United States Patent
Hotchkin

(10) Patent No.: US 8,393,822 B2
(45) Date of Patent: Mar. 12, 2013

(54) ROADWAY BARRIER

(75) Inventor: Darren John Hotchkin, Labertouche (AU)

(73) Assignee: Saferoads Pty Ltd, Victoria (AU)

( * ) Notice: Subject to any disclaimer, the term of this patent is extended or adjusted under 35 U.S.C. 154(b) by 404 days.

(21) Appl. No.: 10/591,630

(22) PCT Filed: Mar. 3, 2005

(86) PCT No.: PCT/AU2005/000308

§ 371 (c)(1),
(2), (4) Date: Jun. 8, 2007

(87) PCT Pub. No.: WO2005/085533

PCT Pub. Date: Sep. 15, 2005

(65) Prior Publication Data

US 2007/0253771 A1 Nov. 1, 2007

(30) Foreign Application Priority Data

Mar. 3, 2004 (AU) ..... 2004901104

(51) Int. Cl.
*E01F 15/10* (2006.01)

(52) U.S. Cl. ..... 404/6; 256/13.1

(58) Field of Classification Search ..... 404/6, 9–11; 256/13.1
See application file for complete search history.

(56) References Cited

U.S. PATENT DOCUMENTS

| | | | | |
|---|---|---|---|---|
| 4,423,854 | A * | 1/1984 | Cobb et al. | 256/13.1 |
| 4,496,264 | A * | 1/1985 | Casey | 404/6 |
| 4,553,875 | A * | 11/1985 | Casey | 404/6 |
| 5,007,763 | A * | 4/1991 | Burgett | 404/6 |
| 5,046,884 | A * | 9/1991 | Girotti | 404/6 |
| 5,054,954 | A * | 10/1991 | Cobb et al. | 404/6 |
| 5,145,278 | A * | 9/1992 | Lohrmann | 404/6 |
| 5,425,594 | A * | 6/1995 | Krage et al. | 404/6 |
| 5,531,540 | A * | 7/1996 | Wasserstrom et al. | 404/6 |
| 6,984,088 | B1 * | 1/2006 | Krivoy | 404/6 |
| 7,144,187 | B1 * | 12/2006 | Nolte et al. | 404/6 |
| 7,572,022 | B2 * | 8/2009 | Groeneweg | 362/26 |
| 2003/0086761 | A1 | 5/2003 | Anderson | |
| 2004/0057791 | A1 * | 3/2004 | Bruyere et al. | 404/6 |

FOREIGN PATENT DOCUMENTS

| | | |
|---|---|---|
| AU | 4734593 | 3/1994 |
| DE | 197 35 507 | 11/1998 |
| DE | 202 02 608 | 7/2003 |
| EP | 1 380 696 | 1/2004 |
| WO | 9853146 | 11/1998 |

OTHER PUBLICATIONS

European Search Report from European Application No. EP05706341, dated Sep. 27, 1010 (2 pages).

* cited by examiner

*Primary Examiner* — Raymond W Addie
(74) *Attorney, Agent, or Firm* — Michael Best & Friedrich LLP

(57) ABSTRACT

A lightweight, portable roadway barrier is disclosed. The barrier (3) comprises a structural framework (5, 7, 9) for resisting collapse of the barrier in response to impact of a vehicle and panels (13) mounted to opposite sides of the barrier for deflecting vehicles on impact with the barrier.

15 Claims, 2 Drawing Sheets

ROADWAY BARRIER

Figure 1:
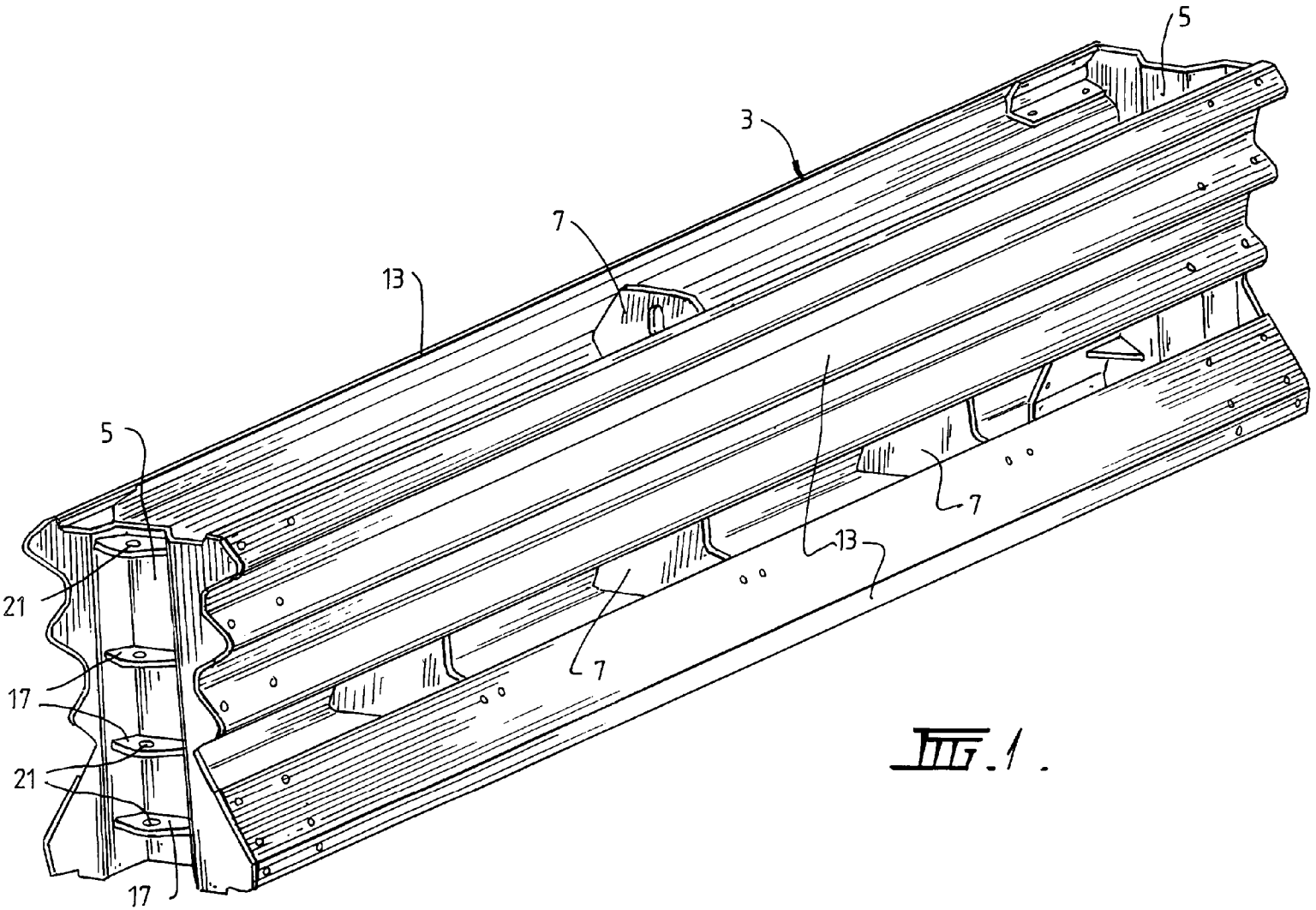

The present invention relates to a barrier for roadways.

The present invention relates particularly, although by no means exclusively, to a lightweight and readily portable metal (which term includes metal alloy) roadway barrier.

Known roadway barriers include:

(a) barriers made from concrete that rely on the weight of the concrete to function as barriers and typically weigh 1,000 kg per meter of the length of the barrier;

(b) barriers that comprise shells made from plastics materials that are adapted to be filled with water and rely on the weight of the water to function as barriers and typically weigh at least 300 kg per meter of the length of the barrier; and (c) barriers made from steel which also rely on the weight of the barriers to function as barriers and weigh at lease 200 kg per meter of the length of the barrier.

Whilst the above-described barriers function effectively as barriers, principally due to the substantial weights thereof, the substantial weights of the concrete and steel barriers presents significant transportation difficulties and the need to fill water into and thereafter empty water from the plastics materials shell barriers presents significant handling issues.

There is a need for a lightweight barrier that functions effectively as a barrier and can be readily be lifted into and from required roadway locations and is immediately functional as a barrier when lifted into position.

The present invention provides a lightweight, portable roadway barrier that comprises:

(a) a structural framework for resisting collapse of the barrier in response to impact of a vehicle, the framework comprising upright members at opposite ends of the barrier and at least one upright member between the end members, and at least one longitudinal member extending along on the length of the barrier and connected to each of the upright members; and (b) panels mounted to opposite sides of the barrier for deflecting vehicles on impact with the barrier.

The internal structural framework of the above-described barrier provides sufficient rigidity for resisting collapse of the barrier in response to vehicle impact.

Specifically, the interconnected arrangement of upright and longitudinal members provides the framework with sufficient rigidity for resisting direct collapse of the barrier in the regions of vehicle impact and from uncontrolled twisting of the barrier around the longitudinal barrier axis.

The principal function of the side panels of the above-described barrier is to deflect a vehicle on impact of the vehicle against the barrier. Accordingly, it is not essential that the side panels make a substantial contribution to the rigidity of the barrier and this makes it possible to minimise the weight of the side panels. Typically, the side panels contribute no more than 30% of the rigidity of the barrier.

In use, the barriers may be a free-standing barrier or may be anchored to the ground.

Preferably the structural framework is made from steel.

Preferably the side panels are made from steel.

Preferably the weight of the barrier is less than 200 kg per meter of length of the barrier.

More preferably, the weight of the barrier is less than 150 kg per meter of length of the barrier.

It is preferred particularly that the weight of the barrier be 100 kg or less per meter of the length of the barrier.

Preferably the upright members are in the form of steel plates.

Preferably the steel plates comprise sections to which the side panels are connected.

Preferably the longitudinal member or at least one of the longitudinal members extends along the length of the barrier and is connected at opposite ends to the upright end members and is connected to the or each upright member located between the end upright members.

Preferably the longitudinal member is positioned at a height that is at or higher than 25% of the height of the barrier.

More preferably the longitudinal member is positioned at a height that is at or higher than 50% of the height of the barrier.

More preferably the longitudinal member is positioned at a height that is at or above a centre of gravity of a typical vehicle.

The applicant has found that the location of the longitudinal member as described in the three preceding paragraphs is preferable from the viewpoint of the overall rigidity of the barrier and in terms of minimising the possibility of lengthwise twisting of the barrier in response to vehicle impact.

Preferably the barrier comprises an upright member positioned midway between the end upright members.

Preferably the central upright member comprises an opening that can receive a crane hook to facilitate lifting of the barrier.

Preferably each side panel comprises a series of lengthwise extending corrugations that define panel ribs.

Preferably the side panels on opposite sides of the barrier diverge outwardly from each other when viewed from the ends of the barrier.

Preferably the barrier further comprises a lower side panel on each side of the barrier that prevents vehicle tyres penetrating the barrier and becoming engaged with the barrier.

Figure 2:
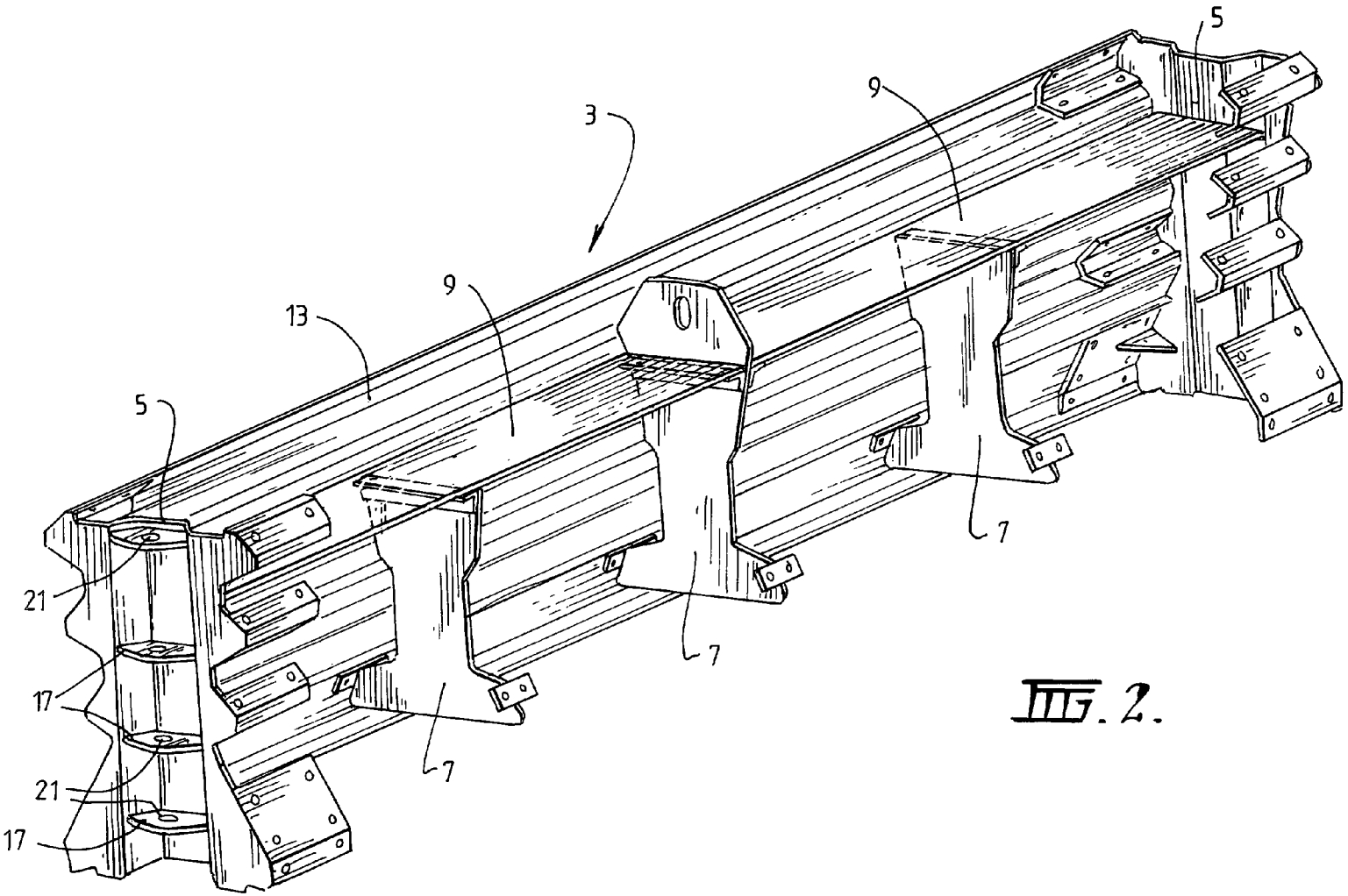

The present invention is described further by way of example with reference to the accompanying drawing, of which:

FIG. 1 is a perspective view of one embodiment of a barrier in accordance with the present invention; and FIG. 2 is a perspective view of the barrier shown in FIG. 1 with the side panels removed to show the internal structural framework of the barrier.

The barrier 3 shown in the Figures comprises an internal structural framework of:

(a) upright support plates 5 at opposite ends of the barrier;

(b) three upright support plates 7 at spaced intervals along the length of the barrier between the end plates 5; and (c) a longitudinal support member 9 (best seen in FIG. 2) in the form of a horizontally disposed flat plate connected at opposite ends to the upright end plates 5 and to the internal upright plates 7 at a height that is approximately 75 per cent of the height of the barrier.

The structural framework is made from steel.

The height of the longitudinal support member 9 is selected to be at or higher than 25%, more preferably 50%, of the height of the barrier and the same as or greater than a centre of gravity of a typical vehicle.

The barrier 3 further comprises side panels 13 that extend along the length of the barrier on opposite sides thereof and are connected to the internal structural framework by bolts and or by welding the components together.

Each side panel 13 is made form steel and is corrugated and comprises three parallel crests and two parallel troughs between the crests.

The upper sections of the upright end plate 5 are similarly corrugated and the side edges of the end plates 5 diverge outwardly to form a "christmas tree" formation when viewed from the ends. Consequently, the side panels 13 diverge outwardly.

Each upright end plate 5 comprises an assembly which enables a plurality of the barriers 3 arranged end-to-end to be hinged together to form a continuous line of the barriers.

Each hinge assembly comprises four horizontally disposed and vertically spaced-apart hinge plates 17 having aligned openings 21.

The positions of the hinge plates 17 are selected so that the hinge plates 17 at one end of one barrier 3 are above or below the hinge plates at the other end of another barrier 3 when the barriers 3 are positioned end-to-end and the openings of the two sets of hinge plates 17 are aligned. Consequently, a hinge pin (not shown) can be inserted through the aligned openings 21 to hinge the two barriers together.

The barrier 3 can be used as a free-standing unit or as a unit that is anchored to the ground.

The applicant has carried out test work in relation to the barrier 3 shown in the Figures.

The test work comprised driving a 2 tonne pick-up truck into a line of the barriers at 100 kilometers per hour and contacting one of the barriers at an angle of 25° to the line. This is a standard industry test to assess barrier performance.

The test work found that the particular steel barrier 3 contacted by the pick-up truck withstood the vehicle impact with an acceptable level of lengthwise twisting of the steel barrier and only a 4 meter deflection of the barriers from the original line of the barriers. In comparative test work, standard concrete and other steel barriers were found to deflect 2 meters out of line and a standard water fill plastics material shell barrier was found to deflect 6 meters.

Many modifications may be made to the preferred embodiment of the invention described above without departing from the spirit and scope of the invention.

Whilst the above described embodiment is constructed from steel, it can readily be appreciated that the present invention is not so limited and extends to barriers made from any suitable materials. By way of example, the side panels 13 could be made from aluminum or suitable plastic materials. It is envisaged that the internal structural framework be made from metals (including metal alloys).

The claims defining the invention are as follows:

1. A lightweight, portable roadway barrier wherein the weight of the barrier is less than 200 kg per meter of length of the barrier, wherein the barrier is a stand alone barrier in that it does not require additional mass to function as a barrier, and wherein the barrier comprises:

(a) a structural framework for resisting collapse of the barrier in response to impact of a vehicle, the structural framework comprising upright members at opposite ends of the barrier and at least one upright member between the end members, and at least one longitudinal member extending along on the length of the barrier and connected to each of the upright members; and (b) panels mounted to opposite sides of the barrier for deflecting vehicles on impact with the barrier, wherein the side panels are made from steel, wherein the upright members are in the form of steel plates, wherein the side panels are connected to the structural framework, wherein the interconnected arrangement of upright and longitudinal members provides the structural framework with sufficient rigidity for resisting direct collapse of the barrier in the regions of vehicle impact and from uncontrolled twisting of the barrier around the longitudinal barrier axis, wherein the principal function of the side panels is to deflect a vehicle on impact of the vehicle against the barrier, and wherein the side panels do not make a substantial contribution to the rigidity of the barrier.

2. The barrier defined in claim 1 wherein the structural framework is made from steel.

3. The barrier defined in claim 1 wherein the weight of the barrier is less than 150 kg per meter of length of the barrier.

4. The barrier defined in claim 1 wherein the weight of the barrier be 100 kg or less per meter of the length of the barrier.

5. The barrier defined in claim 1 wherein the steel plates comprise sections to which the side panels are connected.

6. The barrier defined in claim 1 wherein the longitudinal member is positioned at a height that is at or higher than 25% of the height of the barrier.

7. The barrier defined in claim 1 wherein the longitudinal member is positioned at a height that is at or higher than 50% of the height of the barrier.

8. The barrier defined in claim 1 wherein the longitudinal member is positioned at a height that is at or above a centre of gravity of a typical vehicle.

9. The barrier defined in claim 1 comprises an upright member positioned midway between the end upright members.

10. The barrier defined in claim 9 wherein the central upright member comprises an opening that can receive a crane hook to facilitate lifting of the barrier.

11. The barrier defined in claim 1 wherein each side panel comprises a series of lengthwise extending corrugations that define panel ribs.

12. The barrier defined in claim 1 wherein the side panels on opposite sides of the barrier diverge outwardly from each other when viewed from the ends of the barrier.

13. The barrier defined in claim 1 further comprises a lower side panel on each side of the barrier that prevents vehicle tires penetrating the barrier and becoming engaged with the barrier.

14. The barrier defined in claim 1 wherein the panels extend to a location vertically above the at least one longitudinal member to thereby form a recess in a top of the barrier.

15. The barrier defined in claim 1 wherein the upright members at opposite ends each comprise at least one hinge plate having a respective opening, the opening sized to receive a hinge pin to connect adjacent portions of the barrier.

* * * * *

UNITED STATES PATENT AND TRADEMARK OFFICE

CERTIFICATE OF CORRECTION

PATENT NO. : 8,393,822 B2
APPLICATION NO. : 10/591630
DATED : March 12, 2013
INVENTOR(S) : Darren John Hotchkin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 806 days.

Signed and Sealed this
First Day of September, 2015

Michelle K. Lee

Michelle K. Lee
*Director of the United States Patent and Trademark Office*